US010677565B2

(12) United States Patent
Avni

(10) Patent No.: US 10,677,565 B2
(45) Date of Patent: Jun. 9, 2020

(54) GUIDANCE SYSTEM AND METHOD

(71) Applicant: ISRAEL AEROSPACE INDUSTRIES LTD., Lod (IL)

(72) Inventor: Tsafrir Avni, Shoham (IL)

(73) Assignee: ISRAEL AEROSPACE INDUSTRIES LTD., Lod (IL)

( * ) Notice: Subject to any disclaimer, the term of this patent is extended or adjusted under 35 U.S.C. 154(b) by 125 days.

(21) Appl. No.: 15/536,619

(22) PCT Filed: Dec. 13, 2015

(86) PCT No.: PCT/IL2015/051208

§ 371 (c)(1),
(2) Date: Jun. 16, 2017

(87) PCT Pub. No.: WO2016/098103

PCT Pub. Date: Jun. 23, 2016

(65) Prior Publication Data

US 2018/0245882 A1 Aug. 30, 2018

(30) Foreign Application Priority Data

Dec. 18, 2014 (IL) ..... 236338

(51) Int. Cl.

| | |
|---|---|
| ***F41G 7/26*** | (2006.01) |
| ***G01S 1/70*** | (2006.01) |
| *F41G 7/00* | (2006.01) |

(52) U.S. Cl.

CPC ..... *F41G 7/263* (2013.01); *G01S 1/70* (2013.01)

(58) Field of Classification Search

CPC . F41G 7/263; F41G 7/305; F41G 7/26; F41G 7/303; F41G 7/308; F41G 7/30; G01S 1/70; G01S 17/06

See application file for complete search history.

(56) References Cited

U.S. PATENT DOCUMENTS 3,398,918 A * 8/1968 Girault ..... F41G 7/263 244/3.13
4,096,380 A * 6/1978 Eichweber ..... F41G 7/30 244/3.13

(Continued)

FOREIGN PATENT DOCUMENTS

GB 1315351 A 5/1973

*Primary Examiner* — Bernarr E Gregory
(74) *Attorney, Agent, or Firm* — Dorsey & Whitney LLP

(57) ABSTRACT

A guidance system for remote guidance of a remote platform(s) towards a target destination is disclosed. The guidance system includes a light module including a light source operable for beam to illuminating the remote platform, and a spatial light modulator (SLM) placed in the optical path of the light beam emitted from the light source. The guidance system includes a controller operable for obtaining data indicative of guidance information for navigating the remote platform towards the target destination. The controller operates the SLM to encode the guidance information in the light beam. The guidance information may be encoded in light pattern including at least one of the following: a spatial light pattern formed in a cross-section of the light beam, a temporal light pattern in the light beam, and a spatiotemporal light pattern. The guidance information is encoded in the light beam such that the remote platform can navigate towards the target by detecting at least a cross-sectional region of the light beam, decoding a portion of the guidance information encoded in the detected cross-sectional region and thereby determining guidance instructions for navigating the remote platform(s) towards the target destination.

34 Claims, 3 Drawing Sheets

(56) References Cited

U.S. PATENT DOCUMENTS 4,174,818 A 11/1979 Glenn et al.
4,195,799 A * 4/1980 Sogo ..... F41G 7/26 244/3.13
4,243,187 A 1/1981 Esker et al.
4,299,360 A * 11/1981 Layton ..... F41G 7/263 244/3.13
4,313,580 A * 2/1982 Collette ..... F41G 7/308 244/3.13
4,406,430 A * 9/1983 Krammer ..... F41G 7/26 244/3.13
4,408,734 A * 10/1983 Koreicho ..... F41G 7/26 244/3.13
4,441,669 A * 4/1984 Wich ..... F41G 7/263 244/3.13
4,634,271 A * 1/1987 Jano ..... F41G 7/30 244/3.13
4,709,875 A * 12/1987 Cremosnik ..... F41G 7/26 244/3.13
4,732,349 A * 3/1988 Maurer ..... F41G 7/26 244/3.13
5,102,065 A * 4/1992 Couderc ..... F41G 7/303 244/3.11
5,533,692 A 7/1996 Layton
5,560,567 A 10/1996 Hallmark et al.
5,601,255 A * 2/1997 Romer ..... F41G 7/263 244/3.13
5,647,559 A * 7/1997 Romer ..... F41G 7/305 244/3.13
8,314,928 B2 11/2012 Tzidon et al.
8,386,096 B2 * 2/2013 Stimac ..... G01S 17/06 348/136
9,012,822 B2 * 4/2015 Yu ..... F41G 7/263 244/3.1
9,121,709 B2 * 9/2015 Page ..... G01S 1/70
9,170,435 B2 * 10/2015 Lopez ..... G01S 1/70
2013/0107219 A1 5/2013 Washburn et al.

* cited by examiner

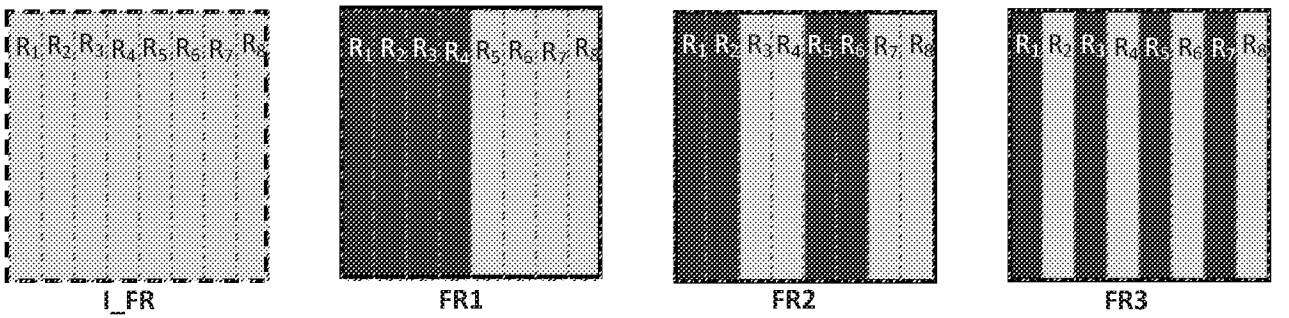
Fig. 3A
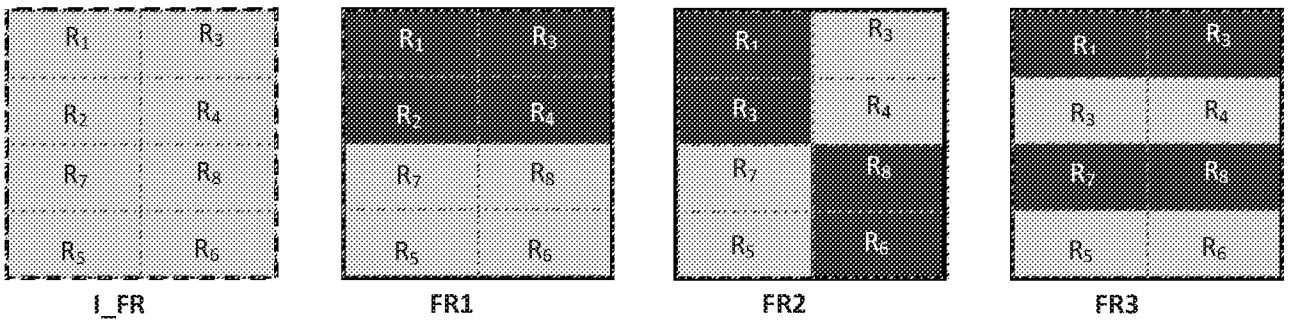
Fig. 3B
| Cross-sectional Region | Pattern Portion | Binary Code | Temporal pattern sequence |
|---|---|---|---|
| $R_1$ | $PPT_1$ | 0111 | |
| $R_2$ | $PPT_2$ | 0110 | |
| $R_3$ | $PPT_3$ | 0101 | |
| $R_4$ | $PPT_4$ | 0100 | |
| $R_5$ | $PPT_5$ | 0011 | |
| $R_6$ | $PPT_6$ | 0010 | |
| $R_7$ | $PPT_7$ | 0001 | |
| $R_8$ | $PPT_8$ | 0000 | |
Fig. 3C

GUIDANCE SYSTEM AND METHOD

TECHNOLOGICAL FIELD

The present invention is in the field of guidance techniques for guiding maneuvering platforms from afar towards a destination, and particularly relates to guidance techniques based on optical signals.

BACKGROUND

Optical guidance is a widely used technique for guiding and navigating remote and typically blind, vehicle platforms towards a target destination.

For example, GB1315351 discloses a method of determining the co-ordinates which an object has in a cross-section of a beam of EM radiation in relation to the axis of the beam. The method is applicable to the control of a flying object being steered along a guiding beam. The beam is produced and transmitted in such a way that any cross-section thereof normal to its axis is an identical projection of the same transmitted image, each component of which provides measurement data corresponding to the coordinates of that component relative to the beam axis. Thus, the co-ordinates of the object in the beam can be evaluated by the object itself from the data. A modulation disc rotating in front of a radiation source produces the image to be projected, components of the image corresponding to values of modulation of the beam and providing the data. In the apparatus for performing the method, a projector forms a radiation source for image projection. The radiation is bunched and projects the modulation disc, as an image. An optical mirror system projects the image in such a way that each cross-section of the beam contains an identical image. The modulation disc may be circular with transparent slots and opaque webs. If the flying body deviates from the beam axis, the measurement data in the image components are used to provide control signals which are fed to the steering gear of the body. The optical image projection system may contain infra-red filters to allow steering of the body by infra-red. To prevent the flying body from deviating further from the beam axis as it moves away from the launch site, the bunching of the radiation is varied. The invention may also be applied to assist the landing of an aircraft when the latter is steered along the beam axis to the landing strip.

U.S. Pat. No. 4,096,380 discloses a system for transmitting light signals between a missile and a missile control launching site by utilizing a laser beam light signal transmission path. The system comprises a laser emitter having a relatively broad transmission beam for producing a transmission path for the modulated light signals during the flight of the missile. The system obviates the need for light transmission lines or other physical connection between the missile and the control station and provides for continuously aiming the laser beam on the missile by means of a follow-up device responsive to a portion of the beam reflected from the missile. At least one crown of triple mirror reflectors is distributed about the axis of the missile to enable the missile to reflect the laser beam impinging thereon independently of the flight position of the missile. The laser beam is modulated to transmit control light signals from the control station and information light signals from the missile.

U.S. Pat. No. 4,243,187 discloses a line of sight guidance system in which the radiated output of a pulsed laser is spatially modulated to produce a beam radiated from an optical projector along a first axis, including a missile or projectile carrying a beam receiver and signal decoder which receives and decodes information in the beam to enable the missile to seek a beam center, with an apparatus for generating a lead angle axis reference for the missile. The basic technique comprises FM modulating the rotational rate of an orbitally driven projected beam chopping spoked reticle. The FM modulation amplitude is chosen to equal the magnitude of the desired angular change of the projected spatially coded axis, while the FM modulation phase is made to equal the direction in which the projected spatially coded axis is shifted. The receiver at the missile interprets the image of the reticle pattern as if the receiver were displaced from the un-modulated first axis position in a direction from the beam center as indicated by the modulation phase. Since the missile is controlled to the beam axis center, it follows the coded axis shift.

U.S. Pat. No. 5,560,567 discloses a method and apparatus for passive tracking and guidance in missile systems. The system is utilized in conjunction with a target acquisition system such as a scanning infrared detection system. The target and missile are sensed and the measured displacement there between is utilized in conjunction with calculated nominal trajectory data to generate guidance control signals. In a preferred embodiment of the present invention, the guidance control signals are transmitted to a receiver on the missile utilizing a radar frequency transmitter.

U.S. Pat. No. 5,533,692 discloses a beam of electromagnetic radiation which is spatially encoded using a digital phase modulation technique. The spatial encoding defines the beam cross section into a series of resolution elements each identified by a different digital code. The codes defining resolution elements are detectable by a missile located in the radiation beam and can be used to define the location of the missile in this beam. In the preferred embodiment, an encoding mask, moved through the beam at its source, provides digital phase modulation. The mask is provided with a series of bit areas, each of which bears at least two sets of cyclically recurring bands effective to modulate a detectable parameter of the radiation, such as intensity. The spacing between adjacent bands of a set, termed a bit cycle, is proportional to a predetermined phase of the modulation of the beam parameter. The novel arrangement enables the missile to identify its position within the beam under conditions of severe atmospheric turbulence and object induced perturbations to provide corrective maneuvers for maintaining the missile velocity vector aligned with the beam.

GENERAL DESCRIPTION

Conventional optical guidance systems operate to transmit optical beams along a line of sight towards the platform while utilizing spatial opto-mechanical masks/reticles which modulate the optical beams to encode control signals for guiding the platform which receives the optical beam.

However, the conventional use of mechanical masks, to optically encode the light beam with navigation information for guiding the platform, bears several significant deficiencies.

For instance, in optical guidance systems utilizing masks to encode spatial light patterns in the light beam, are generally mounted on static tripod, or are stabilized via gimbals so as to compensate for movement/vibrations of the guidance system (e.g. of its output optical port) thereby mechanically stabilizing the light beam emitted thereby. Also in some cases such systems use the gimbals to adjust the direction of the light beam propagation to control the part of the spatial light pattern captured by the platform in accordance with a position of a target towards which the platform is guided. To this end, in conventional optical guidance systems, which are based on opto-mechanical masks, mechanical stabilization (e.g. gimbal-based) modules are utilized, which direct and stabilize the optical axis of the output light beam carrying the spatial light pattern towards the platform. However, such mechanical stabilization modules are generally cumbersome (heavy and/or large and or/require more power consumption and require more components) which restricts the ability to configure such systems as portable systems to be carried by personnel.

Moreover, conventional optical guidance systems using opto-mechanical masks are generally restricted to a finite and a relatively small set of different signals which can be encoded in the light beam (due to the limited numbers/size of mechanical masks which can be furnished/carried by the system). To this end, such conventional optical guidance systems present a severe compromise between the system size/compactness and the versatility of the data/signals that can be encoded by such systems. To enable versatile encoding of signals in the light beam, a large variety of mask patterns may be required thus requiring use of a large number of masks, and/or masks having larger sizes and having regions defining different patterns therein. This leads to a compromise between a cumbersome guidance system capable of providing versatile and accurate guidance information, and/or a more compact system, providing less versatile/less accurate guidance information.

Furthermore, using opto-mechanical masks to temporally encode navigation information by temporal modulation of the light beam, yields poor results. This is because applying such temporal modulation involves switching the masks/mask-sections which are placed in the optical path of the light beam. However this, in turn, involves mechanical motions of the mask(s) which yield spatial and/or temporal smearing of the light pattern. This may result in high rate of false identifications of the correct optical spatial/temporal pattern by the receiving platform and thus misinterpretation of the navigation information encoded in the pattern. Also the mechanical rate of exchange of masks in the optical path of the light beam, is generally low (e.g. restricted by mechanical constraints and by the allowable degree of pattern smearing), therefore providing low temporal data rate in the transmission, which requires relatively long durations to transmit required navigation information. Accordingly, using the mechanical masks to apply temporal encoding of navigation information in the light beam may yield temporal patterns extending over relatively long durations (e.g. in the time scale of milliseconds to nanoseconds) which may not be suitable for use with agile optical guidance systems used for guiding agile platforms which move with high speeds/accelerations and/or which are designed for tracking agile targets.

The present invention is directed to solving at least some or all of the above described deficiencies of conventional techniques. This is achieved by providing a novel guidance system and method for remote guidance of platforms (e.g. remote vehicle/unmanned platforms) used towards a target destination (e.g. target location/path/object), by directing to the platform(s) to be guided, an optical beam encoded with guidance information for guiding the platform(s). The system of the invention utilizes a spatial light modulator (SLM) placed in an optical path of an optical beam that is directed towards the platform. The SLM is operated to encode guidance information on the optical beam such that the platform can be navigated in a controlled course towards the target destination by detecting at least a cross-sectional region of the light beam and decoding a portion of the guidance information encoded therein to determine guidance instructions for navigating towards the target. As will be described in more detail below, the system and method of the invention allow simultaneous guidance of a plurality of platforms towards the target destination.

To this end, the present invention overcomes certain prominent deficiencies of conventional techniques as it permits versatile encoding (digital encoding) of a large variety of light patterns in the light-beam (e.g. spatial, temporal and/spatiotemporal patterns may be used according to the invention to encode the guidance information), while maintaining that the guidance system is relatively compact (no additional masks are used to provide the large variety of patterns). Also, as will be apparent from the description below, the SLM may be operated according to the present invention to stabilize the pattern it encodes on the light beam thus possibly obviating or at least reducing a need for using mechanical stabilizers (gimbals) to stabilize the output light beam. Also, the pattern may be dynamically varied (laterally-shifted/scaled) in accordance with the position/distance of the platform, thereby improving the accuracy of the pattern reception at the platform. Furthermore, according to the present invention the SLM may be operated to dynamically switch between different programmable spatial patterns at a fast rate and/or to form temporal patterns with high data rates. To this end, the different programmable spatial patterns may be programmed/designed in real time, and/or they may be selected from preprogrammed set of masks. The selected patterns may be designed to deal with various scenarios. For instance, pattern smearing artifacts, may be avoided/reduced by laterally "shifting" a pattern dynamically according to some movements of the system. This may involve real time processing associated with the generation of a new/modified (e.g. shifted) pattern from default pattern stored in memory. Also, by the dynamic switching between patterns may be used to encode various commands (e.g. return-to-base/cancel-mission commands and/or any other command that are not part of the guidance instructions set.

Thus according to a broad aspect of the present invention there is provided a guidance system for remote guidance of a remote platform towards a target destination (hereinafter target). The guidance system includes a light module (i.e. including a light source, typically laser), a spatial light modulator (SLM, such as a liquid crystal module (LCoS) or mirror array (DMD/MEMS scanning mirrors) placed in an optical path of light beam emitted from the light source, an optical output portion directing the light beam towards the platform, and a controller. The controller, which may be implemented by using analogue and/or a digital processing circuit, although typically it is implemented digitally by utilizing digital/computerized processor(s)) and is configured and operable for obtaining data indicative of guidance information for navigating the remote platform towards said target destination, and operating the SLM to encode the guidance information on the light beam. This thereby enables navigation of the platform to the target. For instance, the platform may detect at least a cross-sectional region of the light beam and decode a portion of the guidance information encoded in the detected cross-sectional region to determine guidance instructions for navigating it towards the target destination.

According to some embodiments of the present invention the controller is adapted to operate the SLM to encode the guidance information in light patterns including at least one of spatial light pattern formed in the cross-section of the light beam, and a temporal light pattern in the light beam.

More specifically, in certain embodiments the light pattern is a spatiotemporal pattern. The controller in such embodiments operates the SLM to define a plurality of spatially distributed cross-sectional regions within a cross-section of the light beam and to define distinguishable temporal light patterns in these regions respectively by temporally modulating light intensities in these regions with distinguishable temporal modulation patterns, which are indicative of respective guidance instructions for navigating the remote platform, when it is exposed to any one of them, towards the target destination.

To this end, the platform may determine the guidance instructions by:

- detecting light of at least one of the cross-sectional regions of the light beam;
- identifying a respective temporal modulation pattern modulating the detected light in the cross-sectional regions of the light beam; and
- determining the guidance instructions based on an identified respective temporal modulation pattern.

For example, the distinguishable temporal light patterns may be respectively indicative of locations of the cross-sectional regions associated therewith with respect to the cross-section of the light beam. Accordingly, determining the guidance instructions may include utilizing (processing/decoding) the respective temporal modulation pattern to determine the location of a cross-sectional region within the cross-section of the light beam and determining the guidance instructions based on that location.

In some embodiments of the present invention the temporal modulation pattern in the regions of the light beam also encode at least one additional data piece relating to said guidance information. For example the additional data piece may include data indicative of a degree of convergence of motion path of said platform towards the target.

In some embodiments of the present invention the controller is adapted to operate the SLM to spatially modulate light intensities in the plurality of spatially distributed cross-sectional regions within the light beam such as to form a spatio-temporal pattern in the light beam.

In some embodiments of the present invention the controller is adapted to obtain distance data indicative of a distance between the platform and an optical output of the guidance system, and obtain data indicative of a degree of collimation of the light beam. The controller then operates the SLM to modify a scale of the spatial light pattern based on the distance data and the degree of collimation to thereby compensate for divergence of the light-beam when it propagates to the platform.

In certain embodiments of the present invention the controller is adapted to obtain optical path data including at least one of:

- stabilization data indicative of deviation of an optical path of said light beam from a nominal optical path along which the light beam should be projected to navigate the platform to the target; and
- target position data indicative of a position of the target destination (the direction/orientation of the nominal optical path itself maybe associated with and determined by the target position);

The controller is adapted to operate the SLM to modify the spatial light pattern by laterally shifting it within the cross-section of the beam based on the optical path data, and thereby compensate for at least one of the deviations of the optical path and changes in the position of the target.

To this end the guidance system of the present invention may include inertial sensors capable of sensing the motion of the guidance system. The controller may be adapted to obtain the stabilization data at least partially from the inertial sensors. Alternatively or additionally, the guidance system may be associated with or include a tracking camera operable for tracking the target. The controller may be adapted to obtain the target position data at least partially based on motion/position of the target detected by the tracking camera.

As indicated above, in some embodiments of the present invention the light pattern is a spatiotemporal pattern spatially distributed in a plurality of cross-sectional regions of the light beam, each of the regions being temporally modulated with a respectively distinguishable temporal modulation pattern. To this end, in some embodiments the maximal time duration of the temporal modulation patterns is shorter than a characteristic time interval between consecutive modifications of the lateral position of the spatial light pattern (within the beam cross-section), based on the optical path data. This thereby enables a detection module exposed to a certain cross-sectional region of the light beam to identify a temporal light pattern modulating that region.

In some embodiments the guidance system also includes an optical assembly adapted for directing the light beam towards the platform. This may, for example, include a beam collimator adapted to adjust a degree of collimation of the light beam (e.g. to collimate the light beam), and/or a beam expander adapted to expand the light beam such that a cross-sectional width of the light beam reaching the platform is substantially greater by one or more orders of magnitude from lateral dimensions of a light detector mounted on the platform.

Some embodiments of the present invention also provide a guidance detection module adapted to be furnished on the platform. The guidance detection module may or may not be part of the guidance system. The guidance detection module includes an optical sensor adapted to detect at least one cross-sectional region of the light beam transmitted by the guidance system, and a control unit connectable to the sensor and adapted to carry out the following:

- identify spatial and/or temporal pattern in the at least one detected cross-sectional region of the light beam;
- decode said pattern to determine the navigation instructions encoded therein; and
- operate steering modules of the platform to direct said platform in accordance with said navigation instructions towards said target.

It should be understood that the phrase optical sensor is used herein to refer to any light sensitive sensor/detector which may be an image sensor comprising plurality of light sensitive pixels (hereinafter also referred to interchangeably as pixels or light detectors) or a non-imaging sensor that includes only one or few light sensitive regions (e.g. a light detector including a single pixel).

It should also be noted here that the term pattern is used herein to designate a light pattern which may include at least one of, a spatial light pattern, a temporal light pattern, or both (in which case it is also referred to specifically as spatio-temporal pattern). Such light pattern may be carried by a structured light beam/signal and formed by spatially and/or temporally distributed light portions of the light beam. To this end the spatial and/or temporal light pattern may be formed in the light beam by spatial and/or temporal modulation of the light beam respectively, for example by using the SLM to apply such spatial and/or temporal modulations.

As indicated above, in some embodiments the light pattern in the light beam is a spatiotemporal pattern spatially distributed in a plurality of cross-sectional regions of the light beam. Light in said plurality of cross-sectional regions is temporally modulated with respectively distinguishable temporal modulation patterns. The control unit is therefore adapted to identify temporal modulation pattern in the detected cross-sectional region, and determine guidance instructions based on such temporal modulation pattern. To this end, the sensor of the guidance detection module may include only one sensor light sensitive pixel (i.e. a single light detector or a single pixel) capable of detecting the temporal modulation pattern encoded in the cross-sectional region of the light beam (indeed more than one such light-detector/pixel may also be used in the guidance detection module for redundancy to improve reliability of the system). The lateral dimensions of the light sensitive pixel/detector are generally substantially smaller than lateral dimensions of the cross-sectional region which is to be detected by the platform, thereby providing that the light sensitive pixel/detector senses the temporal light modulation pattern from substantially a single one of the cross-sectional regions thereby. This enables to accurately and unambiguously determine/identify the temporal light modulation pattern modulating that region.

To this end, in some embodiments the duration/period of the temporal modulation pattern is typically made substantially shorter than a characteristic time interval between consecutive modifications of lateral position and/or scale of the spatiotemporal light pattern (whose modifications are carried out for example to compensate for deviations of the optical path and/or changes in the position of the target). Accordingly, the light sensitive pixel is operated with an integration time substantially shorter than duration of the temporal modulation pattern (and more specifically in the order of, or below, the time duration of a minimal temporal feature in that pattern). That is, the integration time is shorter by an order of magnitude or more than the characteristic time interval at which consecutive modifications of lateral position and/or scale of the spatiotemporal light pattern are sought/possible by the system.

According to some embodiments of the present invention the guidance system is configured and operable to transmit the light beam to propagate to the platform with cross-section lateral dimensions that are two or more orders of magnitude larger than lateral dimensions of the platform. More specifically, lateral dimensions of the light beam reaching the platform are set to be larger than the nominal/typical distance between two or more co-driven platforms driven in a structure. This enables simultaneous guidance of a plurality of platforms towards the target. Alternatively or additionally transmitting the light beam to propagate to the platform with cross-section lateral dimensions that are one or more orders of magnitude larger than lateral dimensions of the platform may be used for permit dynamic shifting of the pattern inside the guidance light beam so as to compensate of instability of the guidance light beam and/or to use such shifting for guiding the platform to the target.

Accordingly, each of the co-driven platforms may be exposed to a respective spatial region in the light beam which carries temporal modulation patterns encoding respective guidance instructions to guide it to the target. Such temporal modulation patterns may for example encode data indicative of a direction of the target with respect to a platform being exposed to that region, and at least one additional data piece indicative of a desired degree of convergence of motion path of the platform towards the target. The additional data piece enables to avoid collisions between the plurality of platforms when they approach the target.

In another broad aspect of the present invention there is provided a method for remote guidance of a remote platform towards a target destination. The method includes:

- operating a light source to generate a light beam to illuminate the remote platform;
- providing a spatial light modulator (SLM) placed in an optical path of the light beam;
- obtaining data indicative of guidance information for navigating said remote platform towards the target destination; and
- operating the SLM to encode the guidance information on the light beam and thereby enable navigation of the platform to the target.

As indicated above, in some embodiments of the present invention the method includes operating the SLM to form a spatiotemporal pattern encoding guidance information on the light beam. The spatiotemporal pattern may be formed by operating the SLM to spatially and temporally modulate light intensities in the plurality of spatially distributed cross-sectional regions in the pattern. The spatiotemporal pattern includes:

i. A spatial light pattern defining a plurality of spatially distributed cross-sectional regions within a cross-section of said light beam; and ii. Distinguishable temporal light patterns formed in said regions respectively by temporally modulating light intensities in the regions of the light beam with temporal modulation patterns, the distinguishable temporal light patterns being indicative of respective guidance instructions for navigating the remote platform, when exposed to any one of the temporal light patterns, towards the target destination.

For example, according to the method of the invention the temporal light patterns may be respectively indicative of at least locations of the cross-sectional regions associated therewith, with respect to the cross-section of the light beam. Accordingly the guidance instructions may be determined by a platform exposed to one of these cross-sectional regions based on one of its locations, as encoded in the temporal modulation pattern in that region.

In some embodiments of the present invention the method also includes providing distance data indicative of a distance towards the platform, and data indicative of a degree of collimation of the light beam, and operating the SLM to adjust a scale of the spatial light pattern based on the distance data and the degree of collimation so as to compensate for divergence the light-beam propagating to the platform.

In some embodiments of the present invention the method also includes providing optical path data including at least one of the following:

i. Stabilization data indicative of deviation of an optical path of said light beam from a nominal optical path along which said light beam should be projected to navigate said platform to said target; and ii. Target position data indicative of a position of the target, from which said nominal optical path can be determined.

In such embodiments the method also includes operating the SLM to adjust a lateral position of the spatial light pattern within the cross-section of the light beam based on the optical path data, to compensate for at least one of the deviations of the optical path and changes in the position of the target.

In some embodiments of the method of the invention the maximal time duration of the temporal modulation patterns is shorter than a characteristic time interval between consecutive adjustments of lateral position and scale of the spatial light pattern. In some embodiments of the method of the invention the cross-sectional lateral dimensions of the light beam are two or more orders of magnitude larger than lateral dimensions of the platform (e.g. larger than a typical distance between adjacent co-driven platform) thereby enabling simultaneous guidance of a plurality of platforms towards the target. To this end the method may include encoding in the distinguishable temporal modulation patterns at least one additional data piece, which is indicative of a desired degree of convergence of motion path of the platform towards the target (to avoid collisions between a plurality of platforms co-driven simultaneously to approach the target).

Thus according to some embodiments of the invention the method includes determining the guidance instructions at the platform by:

- Detecting light of at least one of the cross-sectional regions of the light beam;
- Identifying a respective temporal modulation pattern modulating the cross-sectional regions of the light beam; and
- Decoding the respective temporal modulation pattern to determine the guidance instructions.

The temporal modulation pattern may for example encode the location of the cross-sectional region within the cross-section of the light beam (which is indicative of the direction from the platform to the target) and it may also encode at least one additional data piece (e.g. data indicative of a desired degree of convergence of motion path of the platform towards the target).

In some embodiments of the method and system of the invention the distinguishable temporal light patterns formed in each spatial cross-sectional region of the beam are purely temporal patterns (with no spatial features encoding guidance information within the regions themselves). Accordingly the guidance instructions may be determined from each of the temporal light patterns by detection using an optical sensor including a single light sensitive pixel.

Other features and advantages of the present invention are described in more detail in the detailed description section below. It should be however noted that the invention is not limited by the details described below and that a person of ordinary skill in the art, according to the invention as claimed in the appended claims, will readily appreciate how to carry out other implementations of the invention without departing from the scope of the invention as defined in the claims.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which:

FIGS. 2A to 2F are schematic illustrations exemplifying the operation of the guidance system of the invention in various positions of a platform to be guided thereby with respect to its optical axis, wherein FIGS. 2B, 2D and 2F are perspective views showing the optical beam directed from the guidance system to the guided platform; and corresponding FIGS. 2A, 2C and 2E show a light pattern formed in the spatial light modulator of the guidance system of the invention at each of the states of FIGS. 2B, 2D and 2F respectively;

FIGS. 3A and 3B illustrate two examples of spatiotemporal patterns/modulations, showing optical beams which can be used according to the invention for guiding a platform to a target; and FIG. 3C is a table depicting the temporal modulation patterns of each spatial region in the patterns illustrated in FIGS. 3A and 3B and the codes encoded therein for navigating the platform.

DETAILED DESCRIPTION OF EMBODIMENTS

Figure 1:
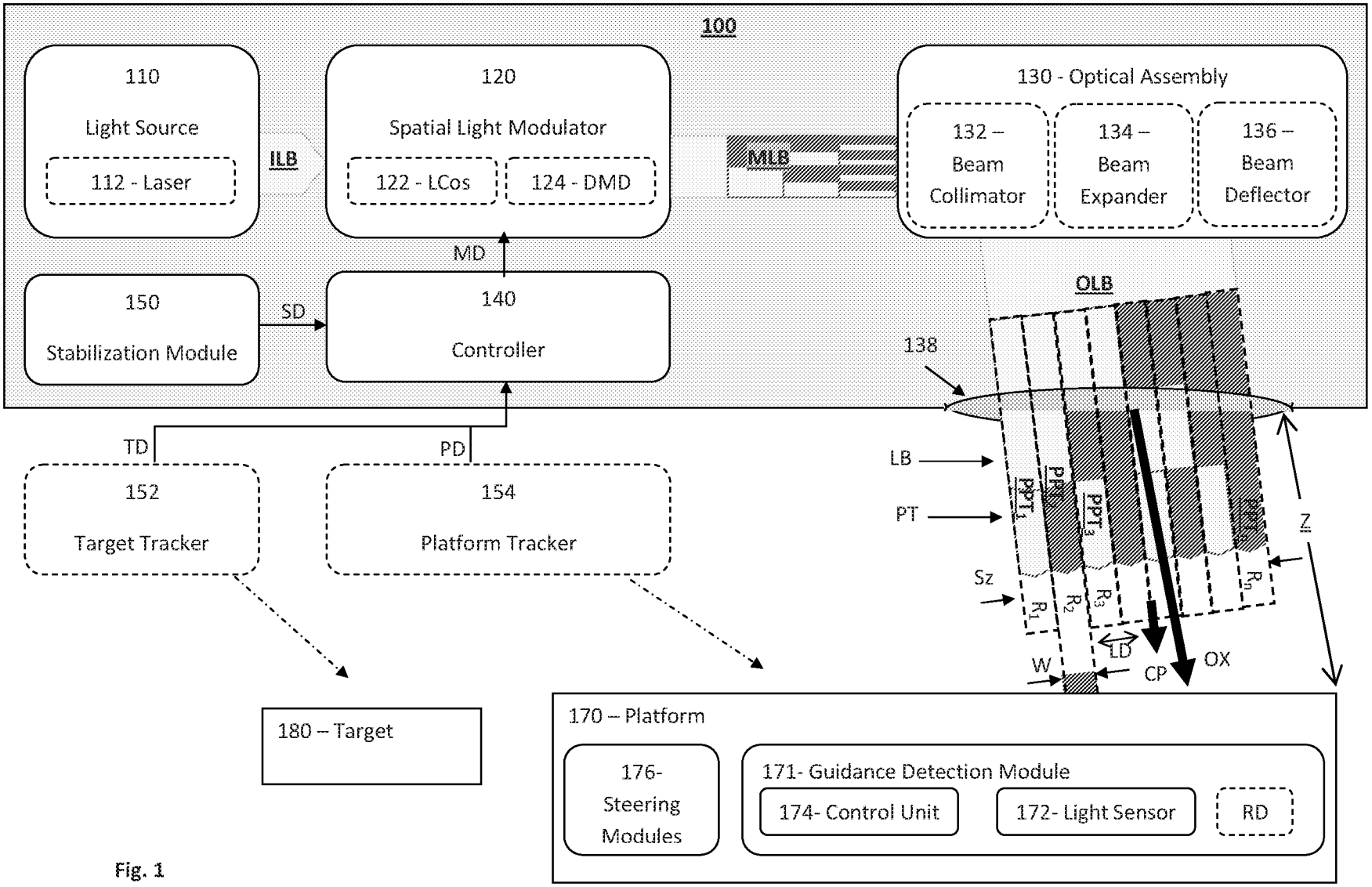
FIG. 1 is a block diagram illustrating a guidance system according to an embodiment of the present invention.

Reference is made to FIG. 1, which is a block diagram illustrating a guidance system 100 according to an embodiment of the present invention. The guidance system 100 is configured and operable to carry out the operations of the method described above and further described in more detail below, to remotely guide a remote platform 170 towards a target destination by transmitting optical beam LB carrying guidance information to the remote platform 170. The guidance system 100 includes a light module comprising a light source 110, such as a laser (e.g. infrared laser), and a spatial light modulator (SLM) 120, such as a liquid crystal based modulator (e.g. LCoS) and/or digital mirror device (DMD) and/or MEMS scanning mirror. The optical beam LB is generated as follows: the light source 110 generates a source optical beam ILB. The SLM 120 is positioned in an optical path of the optical beam LB and is adapted and operated to modulate the optical beam to form a modulated optical beam MLB patterned with pattern PT encoding desired information in the beam. Typically, although not necessarily, the system 100 also includes an optical assembly 130 operable for adjusting the shape and/or direction of the optical beam LB. The optical assembly may be placed along the optical path of the beam LB before or after SLM 120 and/or it may be distributed along the optical path before and after the SLM 120. Accordingly the optical assembly may form the optical beam OLB output from the system 100 such that it has desired shape and divergence angle. The optical beam LB exists in an optical output portion 138 of the guidance system 100 from which it propagates in free space in the direction of one or more remote platforms 170 (a single platform is depicted in the figure). The optical beam LB propagating to the platform 170 is therefore modulated/patterned by the SLM 120 to encode desired guidance information and is shaped by the optical module to have desired shape, divergence (collimation degree), and/or direction. The system 100 may also include a stabilization module 150, including for example inertial sensors (e.g. gyros and/or accelerometers built-in the system 100) and/or other suitable stabilization monitoring modules (e.g. external stabilization monitoring modules), capable of monitoring movements of the system 100 (e g small scale vibrations and/or displacements and/or rotations of the system) and generating data/signals SD indicative of such movements. The controller 140 may be adapted to obtain the stabilization data SD (e.g. sensed by said inertial sensors) and use it when operating the SLM to spatially stabilize the pattern PT which is formed thereby, and to thereby compensate for the movements of the system 100.

To this end, system 100 includes a controller 140 configured and operable for obtaining data indicative of guidance information for navigating the remote platform 170 towards the target destination 180. The target destination 180 may be a target location, to which the platform should reach, and/or a target path to which the motion path of the platform should converge, or a target object to which the platform should be directed. The controller is configured and operable to operate the SLM 120 to encode the guidance information in a light pattern PT in the optical beam LB and thereby enable the platform 170 to navigate to the target 180 by detecting at least a cross-sectional region (e.g. $R_2$) of the light beam and decoding a portion of the guidance information encoded in the detected cross-sectional region $R_2$ and processing to utilizing/processing the decoded portion of the guidance information to determine guidance instructions for navigating the remote platform 170 towards the target destination 180.

The system 100 may optionally include or be associated with a target tracking system 152 (target tracker), such as a radar, a satellite based positioning system, a camera, a tracking device installed on the target 180, and or any other suitable tracking system which is capable of monitoring the position/path of the target 180 and providing communicating data indicative of the same to the controller 140. The system 100 may generally also include or be associated with a platform tracking system 154 (platform tracker), which may also be a radar, a satellite based positioning system, a camera, a tracking device installed on the platform 170, and or any other suitable tracking system capable of monitoring the position/path of the platform 180 and providing communicating data indicative of the same to the controller 140. Each of the target tracker 152 and the platform tracker 154 may be included in the system 100 and/or it may be located remotely from the system. The controller may communicate with the target tracker 152 and the platform tracker 154 to obtain respectively obtain target and platform positioning data TD and PD indicative of the respective positions and possibly also velocities of the target 180 and platform 170. The controller 140 may process this data TD and/or PD to determine guidance information for the platform 170 (e.g. a course along which to direct/navigate/guide the platform 170 towards the target 180).

In certain embodiments the controller 140 is adapted to operate said SLM 120 to encode the guidance information by patterning the optical beam LB with pattern PT. The pattern PT may be a spatial pattern formed in a cross-section of said beam, and/or a temporal light pattern formed in the light beam. The platform 170 is equipped with a guidance detection module 171 adapted to be furnished on the platform. The guidance detection module includes an optical sensor 172 adapted to detect at least a portion of the optical beam LB, and control unit 174 connectable to the sensor 172 and adapted to identify at least a portion (e.g. $PPT_2$) of the pattern PT encoded in the portion of the optical beam LB detected by the sensor 172, and to decode that portion $PPT_2$ of the pattern, and thereby determine navigation instructions for steering the platform towards the target 180. The platform generally also includes steering modules 176, and the control unit 174 is adapted to operate the steering modules 176 in accordance with the determined navigation instructions so that the platform is steered to the target.

To this end, the sensor module 172 may include a single light sensitive pixel/detector or a few pixels and may be exposed to only a fraction (e.g. $PPT_2$) of the cross-section of the optical beam LB. The control unit 174 connectable to the sensor 174 may identify and decode at least one of a spatial and temporal pattern in detected fraction $PPT_2$ of optical beam, to determine the navigation instructions. For example, in some embodiments the optical beam LB is encoded with a spatial pattern defining a plurality of cross-sectional regions, $R_1$ to $R_n$, in the light beam cross-section wherein each region is modulated temporally or spatially to form therein respective fractions $PPT_1$ to $PPT_n$ of the pattern PT. Considering the divergence of the light beam OLB outputted from the system 100 and the distance between system 100 and the platform, the SLM is operated to define/scale the cross-sectional regions, $R_1$-$R_n$, of the light beam such that when any one of them (e.g. $R_2$) impinge on the sensor 172 of the platform 170 its lateral dimensions W are generally substantially wider than the width and height dimensions of the sensor 172 (according to some embodiments of the present invention the lateral dimensions W are substantially wider by one or more orders of magnitude than the platform itself and/or are in the order of/greater than a minimal nominal distance allowed between adjacent co-driven platforms, such that the optical beam can be used to simultaneously navigate a plurality of co-driven platforms to the target). Accordingly the sensor 172 is exposed substantially to only one of the cross-sectional regions of the light beam. In general the light in each cross-sectional region (e.g. $R_2$) of the plurality of cross-sectional regions $R_1$ to $R_n$ in the optical beam LB is modulated (temporally and/or spatially) by the SLM 120 to form therein a respective portion (e.g. $PPT_2$) of the pattern PT of the light beam. The respective portion $PPT_2$ of the pattern is spatially/temporally modulated to encode data indicative of navigation instructions to navigate a platform 170 exposed to this portion $PPT_2$ towards the target 180. In certain embodiments of the invention this data includes at least location data LD indicative of the location of its respective cross-sectional region of the portion $PPT_2$ with respect to a certain reference position CP (e.g. the center) within the cross-section of the pattern PT that is defined in the beam LB. In the following, for clarity and without loss of generality, the reference position CP is considered at the center of the pattern PT, although it may generally be set to any other position.

In turn, the control unit 174 obtains from the sensor 172 sensory data/signals indicative of the portion (e.g. $PPT_2$) captured/sensed by the sensor, and processes/decodes this data to determine the location data LD encoded in the sensed portion $PPT_2$ of the pattern PT. The location data LD may be indicative of one or two dimensional displacements (in arbitrary units, for example in units of distance or unitless) between the cross-sectional region (e.g. $R_2$) at which the pattern portion (e.g. $PPT_2$) is encoded and the reference position is CP.

It should be noted that in some embodiments the control unit 174 utilizes coding reference data/relation RD (e.g. a lookup-table (LUT) and/or a function stored for example in a memory associated with the controller 174), to decode the portion (e.g. $PPT_2$) of the pattern received by the sensor 172 and determine therefrom the location data LD indicating the position of that portion within the pattern PT, and/or directly determining the steering/navigation instructions based on the identified pattern and the reference data. In this regard, the reference data may be a LUT associating various possible patterns which can be identified by the control-unit 174 with corresponding guidance instructions indicated in these patterns, and/or with their respective displacement from the reference position CP. To this end, the control unit 174, decoding the portion $PPT_2$ of the pattern may use the LUT to directly determine the steering instructions, or it may use the LUT to determine the location data and further process the location data LD to determine steering instructions to navigate the platform 170 to the target 180 based on the displacement indicated by the location data LD.

To this end, for example, the one or two dimensional displacements may be indicative of the one or two dimensional steering instructions. For example, the controller may be adapted to continuously steer the platform so as to minimize the displacement between the cross-sectional-region/pattern it receives by the sensor and the reference position CP, and thereby navigate the platform 170 to the target. In cases where the platform is driven on a surface (such as in land vehicles and/or floating marine vehicles), steering is needed with respect to only one steering axis, and therefore the location data encoded in the portion $PPT_2$ of the pattern may indicate a one dimensional displacement from the reference position CP in the pattern PT. In cases where the platform is driven within a three dimensional volume (e.g. airborne vehicles and/or submarine vehicles), steering is required with respect to two steering axes, and therefore the location data encoded in the portion $PPT_2$ of the pattern may indicate a two dimensional displacement from the reference position CP. Accordingly, based on the one/two dimensional displacement, the control unit 174 respectively determines guidance/steering instructions to operate the one/two dimensional steering modules 176 of the platform 170.

Certain embodiments of the invention are designed to operate for navigating remote platforms 170 located at long distances (e.g. in the order of kilometers) from the system 100. This poses several issues relating to location of the pattern PT within the beam BL and the size/lateral-width/height Sz of the pattern PT projected by the system (and the sizes of its respective cross-sectional regions $R_1$-$R_n$), when they reach the remote platform 170, and how to optimize/manage these parameters under constraints associated with the movement stability of the system 100 (e.g. changes in position and/or orientation of the light beam BL output from the optical output 138) and the divergence of the optical beam LB to allow accurate and reliable detection and identification of the correct pattern portion (e.g. $PPT_2$) by the platform 170 so that the correct navigation/guidance instructions are decoded by the platform 170.

To this end, in certain embodiments of the present invention, in order to enable accurate and reliable detection of the correct pattern portion $PPT_2$ by the platform 170, the optical beam LB is projected with a suitable cross-sectional width/diameter and/or with a suitable divergence angle such that when it reaches the remote platform 170 the pattern portions $PPT_1$-$PPT_n$ of the pattern PT carried by the beam LB are each sufficiently wide laterally (e.g. their respective cross-sectional regions $R_1$-$R_n$ of the beam LB are wide enough) so even tolerable stabilization constraints of the system 100, and the sensor of the platform 170 remain mostly covered/illuminated by the same cross-sectional regions (e.g. $R_2$), thus the mostly constantly "seen" same/correct pattern portion (e.g. $PPT_2$), when decoded, provides the correct guidance/steering information to guide the platform to the target 180.

For instance, consider a case where the system 100 guides a platform 170 distant by a distance Z=1 kM therefrom, and wherein the system is designed to operate properly and tolerate vibrational angular beam deviations β of up to β=±0.1°. It should be noted that the system 100 may be exposed to vibrations and/or movements and/or rotations which induce deviations in the beam's direction. Indeed in some cases the system may include mechanical stabilization assemblies such as gimbal-based stabilization configured to at least partially stabilize the beam BL. However, such mechanical stabilization systems are typically cumbersome and also in some cases do not provide full compensation and stabilization over the beam's movement. To this end, consider β to be the desired tolerance to the actual/residual angular deviations of the beam BL, which is obtained after the beam BL, is stabilized by mechanical stabilizers and/or in cases where the beam is not stabilized mechanically. Angular deviation of the beam axis by an angle β would generally result in a lateral/sideway shifting Ls in the pattern portion $PPT_2$ reaching the platform in the order of Ls=Z*Tan(β), where Z is the distance of the platform and β is the tolerance to beam deviations. In this example Ls is to about ±1.75 meters (which is 1 kM times Tan(0.1°)). To this end, in order that the platform 170 be mostly exposed to the same pattern portion $PPT_2$, so it can correctly decode it and interpret its guidance instructions, the lateral dimensions of the pattern portion $PPT_2$ when reaching the platform 170 should be in the order of (e.g. twice or more) the size/lateral dimensions of the lateral/sideway shifting of the pattern due to the vibrations/movement of the system 100. In this example, the size/width W of each of the pattern portions $PPT_1$-$PPT_n$ (or, for that matter, the size of their respective cross-sectional regions $R_1$-$R_n$), should be about 3.5 meters or more when reaching the platform. The entire pattern PT formed in the optical beam LB includes at least a few such pattern portions (e.g. K×L pattern portions) and its lateral extent Sz is even wider when it reaches the platform 170.

Therefore the system 100 may include an optical assembly 130 adjusting the beam LB properties (width and/or divergence and/or shape) before it exits the optical output 138 and propagates in free space to the platform 170. The optical assembly 130 may include a beam expander 134 adjusting the width of the beam LB outputted from the optical output 138 to a desired width, and/or it may include a beam collimator 132 adjusting the divergence of the beam LB outputted from the optical output 138. The beam expander 134 and/or the beam collimator 132 are configured and operable to adjust the shape of the beam such that the cross-sectional regions $R_1$-$R_n$ reach the platform with sufficient width, allowing the platform to detect and decode their respective pattern portions $PPT_1$-$PPT_n$. For example the beam expander may be adapted to expand the light beam LB such that its cross-sectional width, when it reaches the platform, is substantially greater, by one or more orders of magnitude, from lateral dimensions of a sensor 172 mounted on the platform 170. In general, the beam expander 134 and/or the beam collimator 132 may be static optical modules having fixed optical properties and/or they may be controllable/adjustable modules, whose optical properties can be controlled by the controller 140, for example in accordance with the distance of the platform from the system and the required stability tolerance of the system 100 (e.g. the latter may be dynamically determined by the controller 140 by monitoring the rate and/or magnitude of the system's vibrations/movements for example by receiving stabilization data SD indicative of changes in position and/or orientation of the light beam BL the stabilization module 150). It should be noted that in some embodiments, in which a compact and lightweight system 100 is sought, it may be preferable that some or all of the optical modules in the optical assembly 130 are static modules, having generally smaller form factor and weight. To this end, in such embodiments, as well as in other embodiments, the controller may manipulate/modify the pattern projected by the SLM so as to compensate for a need to optically adjust the width and/or collimation of the beam by the beam expander 134 and/or collimator 132 and thereby enable to obviate the need to use controllably adjustable beam expander 134 and/or beam collimator 132. Such manipulations of the pattern projected by the SLM are described in more detail below.

In certain embodiments, it is desired that the form factor and weight of the system 100, is compact and portable (by vehicle and/or even carried by personnel) from place to place. To this end, to satisfy such compactness in a system 100 designed for long distance operation (e.g. in the order of kilometers), the optical assembly 130 may be configured to output the light beam LB such that it is un-collimated and divergent when propagating to the platform. This provides that the optical output 138 may remain compact (e.g. with a radius in the order of centimeters) while the cross-section of the beam LB becomes sufficiently wide (e.g. in the order of meters or more) when reaching the platform 170 so that the platform decodes its information reliably.

According to certain embodiments of the present invention, the controller 140 is configured and operable to manipulate the pattern PT projected by the SLM so as to improve the system's accuracy in navigating the platform 170 to the target 180. In this regard it should be noted that, at best, the platform may be directed to the target with distance accuracy matching/corresponding to the lateral dimensions W of the pattern portions $PPT_1$-$PPT_n$ (namely corresponding to the lateral dimensions of the pattern portion the platform detects). This is because the guidance instructions cannot be received by the platform 170 with spatial resolution higher that the resolution of the pattern portions encoding them. Therefore one of the objectives of manipulating the pattern PT by the controller is to reduce the size/lateral dimensions W of the pattern portions reaching the platform, thereby improving the spatial resolution of the pattern portions, and accordingly the spatial resolution of the navigation instructions towards the target 180. However, as indicated above, the size Sz of the pattern PT and accordingly of its constituent pattern portions $PPT_1$-$PPT_n$ are restricted from below by stabilization constraints/tolerances that the system 100 should endure, and by the fact that optical beam LB is typically made divergent (not collimated) in order to facilitate compactness of the system 100 therefore resulting in the beam's cross-section and accordingly the spatial lateral dimensions of the pattern PT carried thereby, diverging/growing as the platform 170 advances towards the target and its distance from the system 100 grows.

To this end, in certain embodiments of the invention the controller is adapted to manipulate the pattern projected by the SLM 120 to digitally compensate for movement of the system 100, and thereby allow projection of smaller pattern PT including smaller pattern portions $PPT_1$-$PPT_n$. In case the pattern PT is projected with fixed position with respect the beam axis OX, (e.g. for example in case the reference position CP of the pattern is fixed on the beam axis OX) this will result in corresponding shifting of the pattern by the same magnitude of lateral/sideways deviations. However, in certain embodiments of the present invention, the controller 140 is connectable to the stabilization module 150 and is adapted to receiving, therefrom, stabilization data SD indicative of the movement of the system 100. The controller processes the stabilization data to estimate the lateral shift in the position of the beam axis from its nominal position at the distance/location of the platform 170, and utilizes the estimated lateral shift of the beam axis to determine how to modify the pattern projected by the SLM to at least partially compensate for such a lateral shift. To this end, in some embodiments, the raw diameter/pupil of the beam that is produced by the light source 110 and passed through the SLM 120, as well as the SLM 120 itself, are wider than the actual width of the spatial pattern that is formed in the SLM 120 to filter the beam LB. Accordingly, the controller 140 receiving the stabilization data SD may shift the pattern formed by the SLM to at least partially compensate for motions/vibrations of the system. The diameters of the beams LB (the diameter of the raw beam should be denoted without considering the spatial filtering effect of the SLM) and of the PT as a function of distance Z from the system 100 by $d_R(Z)$ and $d_P(Z)$ respectively. To this end, the diameter $d_R(Z)$ of the beam as a function of the distance Z and the divergence angle $\alpha$ is about $d_R(Z)=2*Z*\mathrm{Tan}(\alpha)$, the diameter $d_P(Z)$ of the pattern PT is $d_P(Z)=Rd*d_R(Z)=2*Rd*Z*\mathrm{Tan}(\alpha)$ where Rd is the ratio $Rd=d_P(Z)/d_R(Z)$. Therefore at a distance Z the pattern can be shifted laterally within the beam by lateral shifts of $d_R(Z)-d_P(Z)$ difference between the cross-sectional lateral dimensions of the beam BL and the cross-sectional lateral dimensions of the pattern PT, at a distance Z from the system 100 is $\pm(d_R(Z)-d_P(Z))/2$ meaning that the controller 140 can operate the SLM 120 to laterally shift the location of the pattern PT within the beam by a lateral shift Ls in the range of $Ls=\pm(1-Rd)*Z*\mathrm{Tan}(\alpha)$. Comparing that to the lateral shift needed to compensate the desired tolerance level to angular deviations/vibrations $\beta$ ($Ls=\pm Z*\mathrm{Tan}(\beta)$) this gives the following relation: $(1-Rd)*\mathrm{Tan}(\alpha)=\mathrm{Tan}(\beta)$, which constrains the divergence angle $\alpha$ of the beam BL and the ratio Rd between the SLM/beam lateral size and the pattern size in the SLM, such that digital compensation and stabilization of the pattern PT in the beam against angular deviations of the beam axis OX in the order of $\pm\beta$ is enabled by proper adjustment of the location of the pattern within the SLM.

Considering the example above where the system 100 is exposed to vibrational angular beam deviations $\beta$ of up to $\beta=\pm 0.1°$ and considering an example in which the pattern is formed by the SLM 120 such that the ratio $Rd=d_P(Z)/d_R(Z)$ between the diameters of the pattern PT and the beam LB is about Rd=1/2 (e.g. the SLM is sufficiently large and has sufficient resolution to permit this ratio), and the beam BL is output from the optical output 138 with a divergence angle $\alpha=1°$. In this example, as indicated above, at distance Z of 1 Km, the optical axis OX of the beam LB will be shifted sideways (e.g. vibrations of the system 100) by about ±8.7 meters. That is more than sufficient to compensate and tolerate vibrations up to $\beta$.

Therefore in some embodiments of the present invention the controller 140 obtains optical path data (not specifically illustrated in the figure) including at least one of:

- stabilization data SD indicative of deviation of an optical path/axis OX of the light beam from a nominal optical path (which may be considered in the present example to coincide with the arrow designating the reference position CP in the figure) along which the light beam should be projected to navigate the platform to the target; and
- target position data TD indicative of a position of the target destination (the direction/orientation of the nominal optical path (e.g. considered here to coincide with CP) may be determined by the target position).

To this end, the controller 140 may be connectable to the stabilization module 150 to receive therefrom data indicative of the actual displacement of the optical axis OX of the beam BL from its nominal position. Denoting such data for example by the angle $\beta'$, the controller is adapted to modify the pattern PT projected by the SLM so as to compensate for the displacement $\beta'$ in the beam axis. Considering the above calculations, providing such correction may be achieved for example by laterally shifting the pattern in the SLM 120 to counteract and compensate the angular shift β' in the optical axis OX. The controller 140 may achieve this by shifting the pattern in the SLM with respect to the center of the SLM by a lateral shift $Sft=D_{SLM}*Tan(\beta')/Tan(\alpha)$, where $D_{SLM}$ is the diameter of the active region of the SLM through which the beam passes, α is the beam divergence angle on its propagation to the platform 170 and β' is the input data indicating the deviation of the optical axis of the beam from its nominal position. To this end, in certain embodiments of the present invention the SLM is operated to provide dynamic digital stabilization of the pattern that is projected by the beam thereby enabling to totally obviate mechanical beam stabilization assemblies and/or the SLM may be used to further improve mechanical stabilization provided by less accurate mechanical stabilization assemblies which are less cumbersome.

Additionally or alternatively, in some embodiments of the present invention the pattern in the SLM is also shifted in accordance with changes in the position of the target 180 so as to navigate the platform 170 to the target 180 while the latter moves. To this end the platform 170 may obtain the target's position from the target tracker 152 and operate the SLM 120 to laterally shift the pattern formed thereby by a lateral shift Sft corresponding to the change in the target's position, such that the platform 170 will sense a different pattern portion indicative of the correct navigation instructions towards the target. To this end the shift Sft in this case may be integer multiples of at least half the lateral dimension of the pattern portions PPTs so that the platform is exposed to a different pattern portion carrying different navigation instructions matching the location of the target 180.

Figure 2B:
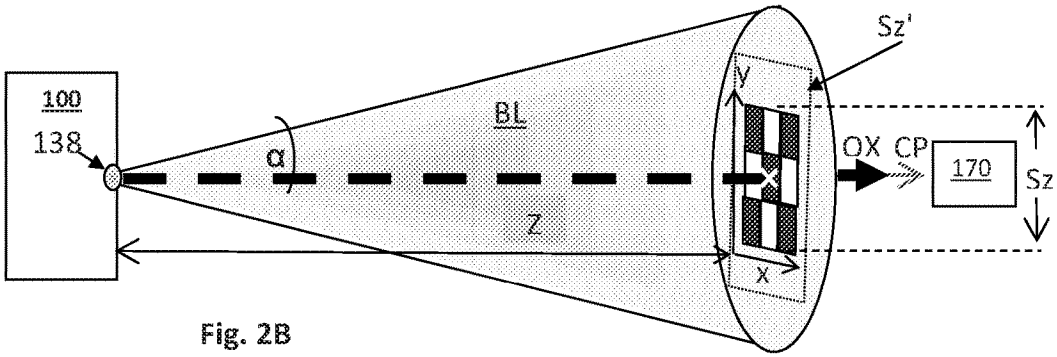
Figure 2D:
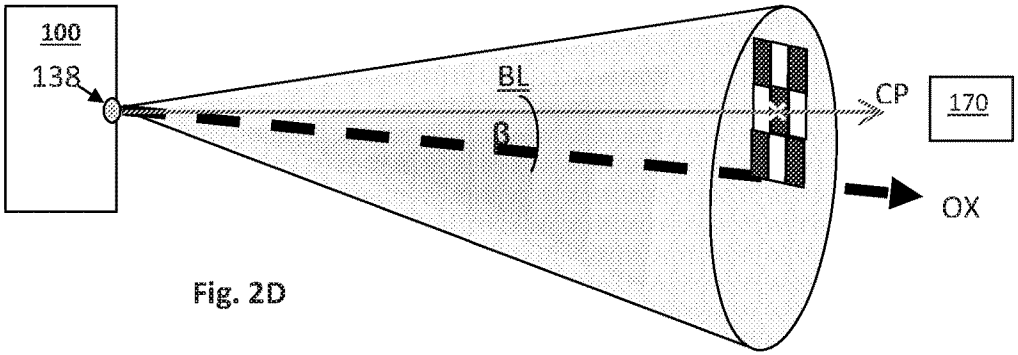
Figure 2F:
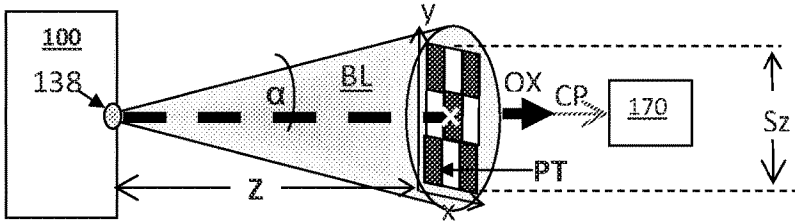
Figure 2A:
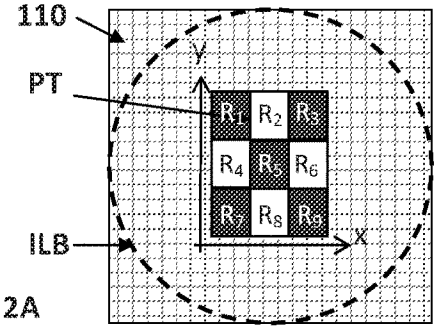
Figure 2C:
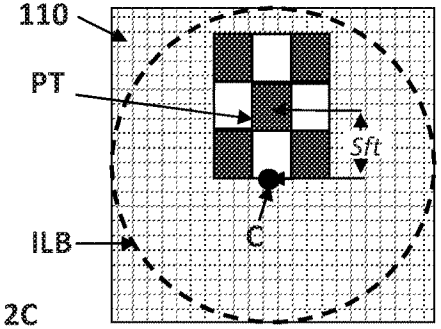

FIGS. 2A and 2B, and FIGS. 2C and 2D exemplify illustratively, in a self explanatory manner, how changing/shifting the position of the pattern PT in the SLM 110 is used according to some embodiments of the present invention to compensate the unstable angular shifts (e.g. vibrations) of the optical axis OX (general light propagation axis) of the beam BL from its nominal position with shift angle β. Where applicable, the same reference numerals are used in these figures to denote objects similar to those described above with reference to FIG. 1. FIGS. 2B and 2D are perspective views of a beam BL directed from the optical output 138 of system 100 to platform 170. Here the platform 170 is depicted in these two figures with the same position relative to the system 100, however in the example of FIGS. 2A and 2B the optical axis OX of the beam is aligned along its nominal position/direction, while in the example of FIGS. 2C and 2D the optical axis OX deviates from its nominal position/direction by an angle β. FIGS. 2A and 2C correspond respectively to FIGS. 2B and 2D, and show the patterns PT formed by the SLM 110 according to the present invention in cases where the optical axis OX is in its nominal position, and in case it deviates from its nominal position by the angle β. For clarity, the edges of the beam ILB impinging the SLM 110 are illustrated on the SLM 100 in a dashed circular line. It should be noted that pixels of the SLM which are outside the pattern PT may be darkened/opaque so that no light from the beam IBL is emitted (they traverse the SLM) except for the light of the pattern PT. As illustrated in FIG. 2A, when the optical axis is in its nominal position, the controller may operate the SLM 110 to form the pattern PT at its center. Accordingly the pattern is centered about the optical axis OX. As shown in FIG. 2B, considering for example that the reference point CP of the pattern PT is arbitrarily selected to be at the center of the pattern PT, the reference point in this case coincides with the optical axis OX and is depicted at the center of the pattern PT. As illustrated in FIG. 2C, when the optical axis deviates from its nominal position by angle β, the controller 140 may operate the SLM 110 to form the pattern PT at shifted position, shifted with respect to the center C of the SLM 110 by lateral shift Sft as indicated above. Accordingly, the pattern PT projected in this case towards the platform is not centered about the optical axis OX; however the shift Sft is selected such that the reference point CP in the pattern PT reaching towards the platform, maintains the same position as that of FIG. 2A. Accordingly the deviation β of the optical axis is compensated and a platform position at the same place in FIGS. 2B and 2D will see the same pattern portion and thus will decode the same navigation instructions, although the optical axis OX might have been shifted.

As indicated above the platform 170 may be directed to the target 180 with lateral accuracy matching/corresponding to the lateral dimensions of the respective pattern portion it sees (e.g. $PPT_2$) when reaching the target 180. However, if no manipulation is performed by the controller 140, and considering divergence angle $\alpha>0°$ of the beam BL, then as the platform 170 approaches the target and typically increases its distance Z from the system 180, the size Sz (i.e. lateral dimensions(s)) of the projected pattern portion captured by the platform 170 is proportional to $Sz\sim 2Z*Tan(\alpha)$ (namely it grows linearly with the distance Z by the factor $Z*Tan(\alpha)$). Since the size Sz of the captured pattern portion relates to the guidance accuracy (which cannot be with higher resolution than the size of the pattern portion captured by the platform 170), therefore in some embodiments of the invention the controller manipulates the size Sz of the captured pattern portion in accordance with the distance Z of the platform (e.g. in order to maintain the size Sz substantially constant as the platform pattern approaches the target, or even to reduce the size Sz when the platform approaches the target in order to improve guidance accuracy). To this end, in certain embodiments of the present invention, the controller 140 is adapted to obtain distance data indicative of a distance Z between the platform 170 and the system 100 (e.g. from the optical output 138), and is also adapted to obtain data indicative of a degree of collimation (collimation/divergence angle α) of the optical beam LB and adjust the scale of the pattern PT projected from the optical output 138 pattern in accordance with the distance Z and the divergence angle α (e.g. to compensate for divergence of the beam LB along its path to the platform 170). To this end, adjusting the scale of the pattern PT may be achieved by carrying out one or both of the following operations:

(i) In case the optical assembly includes a controllable beam collimator 132, the controller 140 may control the scale of the pattern by operating the beam collimator 132 to adjust the divergence angle α of the beam BL (e.g. setting the angle α to be about $\alpha\sim ArcTan(Sz/2Z)$);

(ii) Additionally or alternatively, the controller 140 may operate the SLM 120 and modify a scale of the pattern PT projected thereby based on the distance Z data and the divergence angle α (e.g. in case the size of the pattern captured by the platform should be maintained substantially fixed, a scaling factor SF proportional to $SF\sim 1/(Z*Tan(\alpha))$ may be used). Indeed controlling the size/lateral-dimensions(s) Sz captured pattern by operating the SLM 120 provides an additional advantage associated with the ability to separately and independently adjust the two lateral dimensions $Sz_x$ and $Sz_y$ along two respective lateral axes x and y of the pattern.

To this end it should be noted that the distance Z may be obtained by the controller 140 from the platform tracker 154 monitoring the platform's location and/or from any other suitable distance measurement system, such as known in the art laser based distance measurement modules (e.g. such as a laser range finder (LRF)).

Figure 2E:
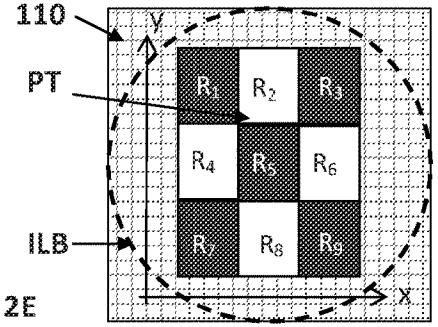

FIGS. 2A and 2B, and FIGS. 2E and 2E exemplify illustratively, in a self explanatory manner, how changing the scaling factor SF according to operation (ii) above, is used according to some embodiments of the present invention to adjust the size Sz of the pattern (and the sizes of the pattern portions/regions) perceived by the platform. As indicated above, the size Sz may be adjusted by the controller in order to preserve the accuracy of the navigation (compensate for the changes in the size Sz resulting from the divergence a of the beam BL) or in order to improve navigation accuracy (reduce the pattern size Sz), as the platform approaches the target 180. Where applicable, the same reference numerals are used in these figures to denote objects similar to those described above with reference to FIG. 1. FIGS. 2B and 2F are perspective views of a beam BL directed from the optical output 138 of system 100 to platform 170 where the platform is depicted at different, respectively relatively long and relatively short distances Z from optical output 138 of system 100. FIGS. 2A and 2E are illustrations of the SLM 110 with the patterns PT formed thereon, corresponding to the distances Z of the platform shown in the corresponding FIGS. 2B and 2F. For clarity, the edges of the beam ILB impinging the SLM 110 are illustrated on the SLM 100 in dashed circular line. As shown in FIGS. 2A and 2B as the platform 170 gets farther from the system 100, the pattern PT in the SLM 110 is scaled down as compared to the pattern PT in FIGS. 2E and 2F where the distance Z to platform 170 is shorter (and vice versa the pattern in the SLM 110 is called up as the platform 170 gets closer), so that the pattern PT reaching the platform has, in this example, substantially the same size Sz when reaching to the platform 170 located at various distances Z.

As indicated above each of the pattern portions $PPT_1$-$PPT_n$ is modulated by a spatial and/or temporal code encoding data indicative of respective navigation instructions to navigate a platform 170 exposed thereto towards the target 180. Indeed it is possible according to the present invention to use spatial modulation in each of the pattern portions $PPT_1$-$PPT_n$ to at least partially encode therein their respective navigation instructions. In such cases the respective region (for example R2) each corresponding pattern portion (e.g. $PPT_2$) is spatially modulated and thus divided into a plurality of smaller sub-zones (not specifically shown in the figure) in which bits of the information (navigation instructions) of the pattern portion $PPT_2$ are encoded. There are various known in the art spatial encoding techniques which can be used in the frame of the present invention for spatially encoding information (navigation instructions) in a region (e.g. $R_2$) of a light beam. A person of ordinary skill in the art will readily appreciate how to use such spatial encoding techniques. Yet it should be noted that when the pattern portion $PPT_2$ is captured by the sensor 172 of the platform 170, the sizes of the sub-zones should be smaller than the sensor 172 (e.g. the size of each sub-zone should be in the order of one or a few pixels of the sensor), and their density should be sufficiently high (e.g. in the order of, or somewhat less than, the density of the pixels in the sensor 172) so that the sensor can capture the complete spatial pattern encoded in the pattern portion $PPT_2$ and correctly interpret the navigation instructions encoded therein. To this end, due to typical stabilization constraints, the lateral dimensions W of each of the pattern portions $PPT_1$-$PPT_n$ should be typically much larger than the dimensions of the sensor, therefore in cases where spatial modulation is used in the pattern portions, it is incorporated cyclically/repeatedly, so that the sensor can decode the information encoded in the pattern portion even when it sees only a spatial fraction of the pattern portion.

However, in some embodiments it is disadvantageous to use spatial encoding of the navigation instructions within the pattern portions $PPT_1$-$PPT_n$. This is because such spatial encoding may reduce the reliability of the detection and decoding of the navigation information encoded in the pattern portions. This is because, as indicated above, the size of the sub-zones, which should be, in that case, in the order of the pixels of the sensor 172, is small as compared to the typical length scale of un-stabilized movement of the pattern PT or of the beam BL, and therefore unsterilized movement/vibration of the beam BL may result in smearing of light detected from the sub-zones and thus reduce the reliability of the decoding of the detected pattern portion $PPT_2$. Also, as the sub-zones are small, in the order of few pixels, in case the sensors detect an edge/boundary between two or more pattern portions (e.g. the boundary between $PPT_2$ and $PPT_3$ it may sense sub-zones from the two or more pattern portions and therefore misinterpret the encoded information.

Therefore, according to certain embodiments of the present invention improved reliability and accuracy of the navigation is obtained by using purely temporal modulation/data (with no spatial light structure) in the regions $R_1$-$R_n$ encoding in each of the pattern portions $PPT_1$-$PPT_n$ (and/or possibly by using combined temporal and spatial encoding with relatively large sizes of the spatial sub-zone of the spatial encoding, e.g. such that only a few such zones can fit and be simultaneously captured by the sensor). To this end it may be preferable to use the purely temporal encoding of the pattern portions $PPT_1$-$PPT_n$, in which case, in each time frame of the temporal encoding, each of the regions $R_1$-$R_n$ of the pattern portions $PPT_1$-$PPT_n$ project substantially spatially homogeneous light intensity. This resolves the above mentioned issues associated with the small size of the sub-zones of the spatial encoding as the sensor is mostly (except in rare cases where the sensor is precisely placed in the boundary between adjacent regions e.g. $R_2$ and $R_3$) substantially covered by homogeneous light from the same region (e.g. $R_2$) associated with the single pattern portion (e.g. $PPT_2$) and therefore is less susceptible to un-stabilized movement of the beam/pattern and/or to edge effects.

To this end, in some embodiments of the present invention the controller 140 is adapted to operate the SLM 120 to define spatiotemporal light pattern PT encoding navigation information in the beam BL. The spatiotemporal light pattern includes spatial light pattern defining a plurality of spatially distributed cross-sectional regions $R_1$-$R_n$ within a cross-section of the light beam BL. Each cross-sectional region of the regions $R_1$-$R_n$ is associated with a respective one of the pattern portions $PPT_1$-$PPT_n$, and encodes different navigation instructions, via a temporal pattern/modulation of the light therein (e.g. while the light in the region is substantially homogeneous). To this end the temporal patterns/modulations in the respective regions $R_1$-$R_n$ are distinguishable patterns encoding different instructions. The temporal patterns may be formed by operating the SLM 120 to temporally modulate the light intensities in these regions $R_1$-$R_n$ in accordance with the navigation data/instructions to be encoded in each region. For example, as indicated above, the distinguishable temporal light patterns may be respectively indicative of locations LD of the cross-sectional regions associated therewith $R_1$-$R_n$, with respect to the cross-section of the light beam (e.g. with respect to the reference position CP). This provides reliable encoding and decoding of the guidance information in the beam BL which is less susceptible to un-stabilized movements of the pattern PT (such un-stabilized movement may be a residual un-stabilized motion of the spatial pattern in the beam which may remain even after the beam/pattern are stabilized mechanically by gimbals and/or digitally by properly operating the SLM).

In certain embodiments the temporal patterns/modulations of the spatiotemporal pattern are transmitted repeatedly (e.g. periodically/cyclically) in each of their respective regions $R_1$-$R_n$, such that the sensor 172 can quickly detect them at any time. It should be noted that generally the time duration/period of the temporal modulation patterns formed in the pattern portions $PPT_1$-$PPT_n$ (e.g. the maximal durations) should be shorter than a predetermined minimal/characteristic time interval during which the guidance instructions in any of the pattern portions may change (namely it should be shorter than the time resolution of the provision navigation instruction of the system 100) so that in between consecutive navigation information updates of the pattern PT, the sensor 172 of the detection module 170 can identify the temporal light pattern to which it exposed. For fast moving targets and/or a platform this may be in the scale of microseconds (μSec). Also, the time duration/period of the temporal modulation should preferably be shorter than characteristic/minimal time between stabilization updates which are used by the controller 140 to stabilize the pattern (by operating the SLM to adjust its lateral position in the beam), so that in between consecutive stabilization related modifications of the pattern PT, the sensor 172 of the detection module 170 can identify the temporal light pattern to which it exposed.

Reference is made now to FIGS. 3A and 3B exemplifying two possible spatiotemporal patterns/modulations of the beam LB, which can be used according to some embodiments of the present invention to navigate a platform 170 towards a target 180. In these examples the pattern is spatially divided into eight cross-sectional regions $R_1$-$R_8$ in the beam BL defining eight respective pattern portions $PPT_1$-$PPT_8$. FIG. 3A is an example of a spatiotemporal pattern PT having one spatial dimension (the regions $R_1$-$R_8$ are distributed in one dimension of the pattern PT) which is usable for navigating the platform motion on a two dimensional surface (e.g. navigating land based vehicles). FIG. 3B is an example of a spatiotemporal pattern PT having two spatial dimensions which is usable for navigating the platform motion in three dimensional space (e.g. navigation aerial platforms). In the examples of both figures the pattern portions $PPT_1$-$PPT_8$ in the regions $R_1$-$R_8$ are distinct from each other and are defined by respectively different/distinguishable temporal modulations of the optical beam in these regions. As shown in the figures, the spatiotemporal pattern PT in this example is formed by three temporal frames FR1-FR3. Each of the temporal frames shown in the figures depicts the spatial distribution of the regions $R_1$-$R_8$ in the pattern PT and their state (transparent/opaque lit/darkened in the SLM 110). The controller 140 operates to the SLM 110 to present these frames in a sequence (the frames may or may not extend to similar time durations) to project the spatiotemporal pattern PT in the light beam BL. The SLM state in the regions $R_1$-$R_8$ in the frames are set such that distinctive temporal light patterns are formed in the regions $R_1$-$R_8$ when these frames are sequentially presented by the SLM in the optical path of the beam BL. To this end in the present example, the SLM is operated to form a binary light pattern with dark/opaque regions presenting for example bit up (binary 1) and lit regions presenting bit down (binary 0). To this end, in order to define n distinct spatial regions $R_1$-$R_n$ presenting distinct binary temporal pattern portions, $Log_2(n)$ frames are required. It should be understood that other (e.g. non-binary) intensity modulation schemes may also be applicable in the present invention enabling to reduce the number of temporal frames needed to define a desired number of distinct regions. In the figures also depicted are optional initialization frames I_FR. These are provided at the starting of the temporal sequence to indicate the beginning of the temporal pattern/modulation to the guidance detection module 171 exposed to the beam BL. The initialization frames are optional and are needed to distinguish between consecutively transmitted temporal pattern portions which are transmitted with short intervals between them. The initialization frames may present a similar light pattern/state in each of the regions so that the guidance detection module 171 can identify them easily, disregarding to which region of the regions R1-$R_8$ they are exposed to. Also the initialization frames may actually include a plurality of predetermined initialization frames presented in a sequence defining an initialization code. The latter may optionally be encrypted to encrypt the guidance beam BL of the system 100.

To this end reference is made to the table in FIG. 3C specifying and depicting in a self explanatory manner the temporal light sequences (modulation patterns) including the initialization frame/bit which are shown in each of the pattern portions $PPT_1$-$PPT_8$ presented respectively in the spatial cross-sectional regions $R_1$-$R_8$. Also, the interpretation of these temporal sequences into corresponding numerical binary codes indicative of the regions in which they are presented, are shown in the table. By determining the code (e.g. 0110) encoded in the temporal pattern portion (e.g. $PPT_2$) it sees, the control unit may determine which region it sees (e.g. $R_2$) and thereby determine the correct navigation instructions towards the target 180.

It should be noted that in some embodiments of the present invention at least parts of codes presented in the temporal modulation patterns/sequences of each of the pattern portions encode data indicative of the direction of the target 180 with respect to the platform 170. In fact, this data may actually be indicative of the location of the cross-sectional regions $R_1$-$R_8$ at the respective temporal modulation patterns with respect to a certain reference location CP in the pattern PT (e.g. the center thereof). Yet in certain embodiments of the present invention other parts of the codes encode additional data associated with the guidance of the platform towards the target.

For example, in some embodiments, an additional data piece included/encoded in the code may be indicative of a degree of convergence of motion path of the platform 170 towards the target 180. That is, the code provides both the direction to the target 180 and also indicates how fast the platform should turn towards this direction. This allows navigating the platform 170 to the target 180 along non-linear paths (e.g. a parabolic path) which may be useful in some scenarios.

As indicated above, in certain embodiments of the present invention the cross-section of the pattern PT in the light beam reaching the platform 170 is substantially larger than the dimensions of the platform. For example it may be one or two orders of magnitude larger than the lateral dimensions of the platform. In cases where the pattern PT is wider than the lateral distance(s) between plurality (two or more) adjacent platforms, it may be used to simultaneously guide the plurality of platforms towards the target 180. In such embodiments/implementations, where the system 100 simultaneously guides the plurality of platforms, encoding the additional data piece indicative of a degree of convergence of motion path of the pattern portion encoding that data is useful as it enables to avoid collisions between the plurality of co-guided platforms approaching the target. This is because it permits directing the plurality of platforms with no linear/parabolic paths to the target, such that the pluralities of platforms meet only in the vicinity of the target.

Turning now to the guidance detection module 171 which is mounted on the platform 170 as illustrated in FIG. 1, it includes the optical sensor 172 adapted to at least partially detect light from at least one cross-sectional region (e.g. $R_2$ of the light beam LB) and a control unit 174 which is connected to the sensor 172 and to the steering modules of the platform 170. The control unit 174 is adapted to process the data/signals that are captured by the sensor 172 and to identify the respective pattern portion (e.g. the temporal modulation pattern of the pattern portion $PPT_2$) modulating the light in the region (e.g. $R_2$) to which the sensor is exposed. The control unit 174 decodes the detected pattern portion $PPT_2$ to determine at least the direction of the target with respect to the platform and thereby determine the navigation instructions, and accordingly operate the steering modules of said platform to direct the platform towards the target.

Since in certain embodiments pattern portions $PPT_1$-$PPT_n$ are spatially homogenous temporal patterns (whose spatial dimension is larger relative to sensor of the platform 170), therefore the sensor 172 in such embodiments need not be able to discern spatial details and may therefore include even only one light sensitive pixel (indeed sensors with more pixels are still useable, and the additional pixels may provide failsafe redundancy). The lateral dimensions of the light sensitive pixel of the sensor 172 are substantially smaller than lateral dimensions of each of the regions $R_1$-$R_n$. Accordingly, the light sensitive pixel of the sensor sense the temporal light modulation pattern of substantially a single region. This enables determining the temporal light modulation pattern accurately and unambiguously. The sensor's pixels are operated with integration time/a frame rate that is shorter (e.g. by one or more orders of magnitude) than the duration of the temporal modulation pattern.

The invention claimed is:

1. A guidance system for remote guidance of one or more remote platforms towards a target destination, the guidance system comprising:

a light module comprising a light source, an optical output portion directing said light beam towards said one or more remote platforms, and a controller;

a spatial light modulator (SLM) placed in an optical path of a light beam emitted from said light source and configured and operable for forming a spatiotemporal pattern within a cross-section of the light beam by dynamically switching between different programmable spatial patterns, and wherein said controller is configured and operable for obtaining guidance information indicative of guidance instructions for navigating the remote platform, and operating said SLM by switching between the different programmable spatial patterns to spatially and temporally modulate the cross section of the light beam for encoding said guidance information in the spatiotemporal pattern in the form of a plurality of spatially distributed cross-sectional regions within the cross-section of said light beam having respectively distinguishable temporal light patterns formed therein, said controller being adapted to obtain distance data indicative of a distance between said one or more remote platforms and said optical output of the guidance system, and obtain data indicative of a degree of collimation of said light beam and to operate said SLM to modify a scale of said spatial light pattern based on said distance data and said degree of collimation of the light-beam to thereby compensate for divergence of said light-beam when propagating to said one or more remote platforms, thereby enabling navigation of said one or more remote platforms to the target by detecting at least a cross-sectional region of said light beam and decoding a portion of said guidance information encoded in said cross-sectional region of said light beam to determine guidance instructions for navigating said one or more remote platforms towards said target destination.

2. The guidance system of claim 1 wherein said distinguishable temporal light patterns are indicative of respective guidance instructions for navigating the one or more remote platforms, when exposed to any one of said temporal light patterns, towards said target destination.

3. The guidance system of claim 2 wherein:

said temporal modulation pattern encodes said location of the cross-sectional region, and at least one additional data piece relating to said guidance information; and said at least one additional data piece includes data indicative of a degree of convergence of motion path of said one or more remote platforms towards said target.

4. The guidance system of claim 1 wherein said distinguishable temporal light patterns are respectively indicative of locations of the cross-sectional regions associated therewith with respect to said cross-section of the light beam.

5. The guidance system of claim 1 wherein said guidance instructions are determined by:

detecting light of at least one of said cross-sectional regions of the light beam;

identifying a respective temporal modulation pattern modulating said cross-sectional regions of the light beam, thereby decoding said portion of the guidance information; and determining said guidance instructions based on said respective temporal modulation pattern.

6. The guidance system of claim 5 wherein determining said guidance instructions comprises utilizing said respective temporal modulation pattern to determine a location of a cross-sectional region within said cross-section of the light beam and determining said guidance instructions based on said location.

7. The guidance system of claim 1 wherein said controller is adapted to obtain optical path data including at least one of:

(i) stabilization data indicative of deviation of an optical path of said light beam from a nominal optical path along which said light beam should be projected to navigate said one or more remote platforms to said target, or (ii) target position data indicative of a position of said target from which said nominal optical path can be determined; and wherein said controller is adapted to operate said SLM to modify said spatiotemporal light pattern by laterally shifting said spatiotemporal light pattern within the cross-section of the beam based on said optical path data, to thereby compensate for at least one of said deviations of the optical path and changes in said position of the target.

8. The guidance system of claim 7 configured in at least one of the following:

said guidance system comprises inertial sensors and wherein said controller is adapted to obtain said stabilization data at least partially based on motion of said guidance system sensed by said inertial sensors; or said controller is associated with a tracking sensor operable for tracking said target and is adapted to obtain said target position data at least partially based on motion or position of said target detected by said tracking sensors.

9. The guidance system of claim 1 wherein a maximal time duration of said temporal modulation patterns is shorter than a characteristic time interval between consecutive modifications of said position of said spatial light pattern based on the optical path data, thereby enabling a detection module exposed to a certain cross-sectional region of said light beam to identify a temporal light pattern modulation.

10. The guidance system of claim 1 configured according to at least one of the following:

said SLM includes at least one of the following:

a digital micro-mirror device (DMD), a liquid crystal device (LCoS), or an array of MEMS mirrors;

said light source is a laser light source;

the guidance system comprises an optical assembly adapted for directing said light beam towards said one or more remote platforms; or said optical assembly comprises at least one of the following:

a beam collimator adapted to collimate said light beam, or a beam expander adapted to expand said light beam such that a cross-sectional width of the light beam reaching said one or more remote platforms is substantially greater by one or more orders of magnitude from lateral dimensions of a light detector mounted on said one or more remote platforms.

11. The guidance system of claim 1 comprising a guidance detection module adapted to be furnished on said one or more remote platforms, said guidance detection module includes an optical sensor adapted to detect at least one cross-sectional region of said light beam and a control unit connectable to said sensor and adapted to identify at least one of a spatial or temporal pattern in said detected at least one cross-sectional region, decode said pattern to determine the navigation instructions encoded therein, and operate steering modules of said one or more remote platforms to direct said one or more remote platforms in accordance with said navigation instructions towards said target.

12. The guidance system of claim 11 wherein:

said light pattern is a spatiotemporal pattern spatially distributed in a plurality of cross-sectional regions of said light beam and wherein light in said plurality of cross-sectional regions is temporally modulated with respectively distinguishable temporal modulation patterns; and said control unit is adapted to identify a temporal modulation pattern in the detected cross-sectional region, and determine said guidance instructions based on said temporal modulation pattern.

13. The guidance system of claim 12 wherein:

said sensor includes at least one light sensitive pixel capable of detecting said temporal modulation pattern encoded in said cross-sectional region of the light beam; and lateral dimensions of said light sensitive pixel are substantially smaller than lateral dimensions of said cross-sectional region, providing that said light sensitive pixel senses said temporal light modulation pattern from substantially a single cross-sectional region thereby enabling accurately and unambiguously determining said temporal light modulation pattern.

14. The guidance system of claim 13 wherein duration of said temporal modulation pattern is substantially shorter than a characteristic time interval between modifications of position and/or scale of said spatial part of said spatiotemporal light pattern and wherein said light sensitive pixel is operated with integration time substantially shorter than duration of said temporal modulation pattern.

15. The guidance system of claim 1 configured and operable to transmit said light beam to propagate to said one or more remote platforms with cross-section lateral dimensions of two or more orders of magnitude larger than lateral dimensions of said one or more remote platforms thereby enabling simultaneous guidance of a plurality of the one or more remote platforms towards said target.

16. The guidance system of claim 15 wherein:

said light pattern being a spatiotemporal pattern comprising a spatial light pattern defining a plurality of cross-sectional regions in a cross-section of said beam, and temporal light patterns formed respectively in said regions; and a temporal modulation pattern in each cross-sectional region encodes data indicative of a direction of said target with respect to one or more remote platforms being exposed to said region, and at least one additional data piece indicative of a desired degree of convergence of motion path of the one or more remote platforms towards said target, and said additional data piece enables to avoid collisions between said plurality of the one or more remote platforms when approaching said target.

17. A method for remote guidance of one or more remote platforms towards a target destination, the method comprising:

operating a light source to generate a light beam to illuminate said one or more remote platforms;

providing a spatial light modulator (SLM) placed in an optical path of said light beam, whereby said SLM is operable for forming a spatiotemporal pattern within a cross-section of the light beam by dynamically switching between different programmable spatial patterns;

obtaining guidance information indicative of guidance instructions for navigating said remote platform;

operating said SLM to spatially and temporally modulate the cross section of the light beam by switching between the different programmable spatial patterns to encode said guidance information in the spatiotemporal pattern in the form of a plurality of spatially distributed cross-sectional regions having respectively distinguishable temporal light patterns within the cross-section of said light beam, and providing distance data indicative of a distance towards said one or more remote platforms, and data indicative of a degree of collimation of said light beam; and operating said SLM to adjust a scale of said spatial light pattern based on said distance data and said degree of collimation to compensate for divergence of said light-beam when propagating to said one or more remote platforms;

thereby enabling navigation of said one or more remote platforms to the target by detecting at least a cross-sectional region of said light beam and decoding a portion of said guidance information encoded in said cross-sectional region.

18. The method of claim 17 wherein said distinguishable temporal light patterns are configured according to one or more of the following:

said distinguishable temporal light patterns indicative of respective guidance instructions for navigating the one or more remote platforms, when exposed to any one of said temporal light patterns, towards said target destination;

said distinguishable temporal light patterns are respectively indicative of at least locations of the cross-sectional regions associated therewith, with respect to said cross-section of the light beam, and wherein said guidance instructions are determined based on said locations;

a maximal time duration of said distinguishable temporal modulation patterns is shorter than a characteristic time interval between consecutive adjustments of lateral position and scale of said spatial light pattern; or said distinguishable temporal modulation pattern encodes at least one additional data piece indicative of a desired degree of convergence of motion path of the one or more remote platforms towards said target.

19. The method of claim 18 comprising determining said guidance instructions at said one or more remote platforms by:

detecting light of at least one of said cross-sectional regions of the light beam;

identifying a respective temporal modulation pattern modulating said cross-sectional regions of the light beam; and decoding said respective temporal modulation pattern to determine said portion of the guidance information indicative of said guidance instructions.

20. The method of claim 17 further comprising operating said SLM to form said spatial light patterns by spatially modulating light intensities in said plurality of spatially distributed cross-sectional regions.

21. The method of claim 17 further comprising:

providing optical path data including at least one of stabilization data indicative of deviation of an optical path of said light beam from a nominal optical path along which said light beam should be projected to navigate said one or more remote platforms to said target and target position data indicative of a position of said target, from which said nominal optical path can be determined; and operating said SLM to adjust a lateral position of said spatial light pattern within the cross-section of the light beam based on said optical path data, to thereby compensate for at least one of said deviations of the optical path and changes in said position of the target.

22. The method of claim 17 wherein said cross-sectional lateral dimensions of said light beam are two or more orders of magnitude larger than lateral dimensions of said one or more remote platforms thereby enabling simultaneous guidance of a plurality of the one or more remote platforms towards said target.

23. The method of claim 22 wherein said distinguishable temporal modulation patterns encode at least one additional data piece indicative of a desired degree of convergence of motion path of the one or more remote platforms exposed to said region towards said target, and said additional data piece enables to avoid collisions between said plurality of the one or more remote platforms when approaching said target.

24. The method of claim 17 wherein said distinguishable temporal light patterns are purely temporal patterns and wherein the guidance instructions are decoded from one of said temporal light patterns detectable by an optical sensor comprising a single sensitive pixel, sensing light from substantially a single cross-sectional region of said light beam.

25. A guidance system for remote guidance of one or more remote platforms towards a target destination, the guidance system comprising:

a light module comprising a light source, an optical output portion directing said light beam towards said one or more remote platforms, and a controller;

a spatial light modulator (SLM) placed in an optical path of a light beam emitted from said light source and configured and operable for forming a spatiotemporal pattern within a cross-section of the light beam by dynamically switching between different programmable spatial patterns, and wherein said controller is configured and operable for obtaining guidance information indicative of guidance instructions for navigating the remote platform, and operating said SLM by switching between the different programmable spatial patterns to spatially and temporally modulate the cross section of the light beam for encoding said guidance information in the spatiotemporal pattern in the form of a plurality of spatially distributed cross-sectional regions within the cross-section of said light beam having respectively distinguishable temporal light patterns formed therein, said controller being adapted to obtain optical path data including at least one of: stabilization data indicative of deviation of an optical path of said light beam from a nominal optical path along which said light beam should be projected to navigate said one or more remote platforms to said target, or target position data indicative of a position of said target from which said nominal optical path can be determined, said controller being adapted to operate said SLM to modify said spatiotemporal light pattern by laterally shifting said spatiotemporal light pattern within the cross-section of the beam based on said optical path data, to thereby compensate for at least one of said deviations of the optical path and changes in said position of the target, thereby enabling navigation of said one or more remote platforms to the target by detecting at least a cross-sectional region of said light beam and decoding a portion of said guidance information encoded in said cross-sectional region of said light beam to determine guidance instructions for navigating said one or more remote platforms towards said target destination.

26. The guidance system of claim 25 wherein said controller is adapted to obtain distance data indicative of a distance between said one or more remote platforms and said optical output of the guidance system, and obtain data indicative of a degree of collimation of said light beam and to operate said SLM to modify a scale of said spatial light pattern based on said distance data and said degree of collimation of the light-beam to thereby compensate for divergence of said light-beam when propagating to said one or more remote platforms.

27. The guidance system of claim 25 configured in at least one of the following:

said guidance system comprises inertial sensors and wherein said controller is adapted to obtain said stabilization data at least partially based on motion of said guidance system sensed by said inertial sensors; or said controller is associated with a tracking sensor operable for tracking said target and is adapted to obtain said target position data at least partially based on motion or position of said target detected by said tracking sensors.

28. A guidance system for remote guidance of one or more remote platforms towards a target destination, the guidance system comprising:

a light module comprising a light source, an optical output portion directing said light beam towards said one or more remote platforms, and a controller;

a spatial light modulator (SLM) placed in an optical path of a light beam emitted from said light source and configured and operable for forming a spatiotemporal pattern within a cross-section of the light beam by dynamically switching between different programmable spatial patterns, and wherein said controller is configured and operable for obtaining guidance information indicative of guidance instructions for navigating the remote platform, and operating said SLM by switching between the different programmable spatial patterns to spatially and temporally modulate the cross section of the light beam for encoding said guidance information in the spatiotemporal pattern in the form of a plurality of spatially distributed cross-sectional regions within the cross-section of said light beam having respectively distinguishable temporal light patterns formed therein, thereby enabling navigation of said one or more remote platforms to the target by detecting at least a cross-sectional region of said light beam and decoding a portion of said guidance information encoded in said cross-sectional region of said light beam to determine guidance instructions for navigating said one or more remote platforms towards said target destination, wherein the system has at least one of the following configurations:

said SLM includes at least one of the following:

a digital micro-mirror device (DMD), a liquid crystal device (LCoS), or an array of MEMS mirrors;

said light source is a laser light source;

an optical assembly is provided having one of the following configurations: the optical assembly is adapted for directing said light beam towards said one or more remote platforms; or the optical assembly comprises at least one of the following: a beam collimator adapted to collimate said light beam, or a beam expander adapted to expand said light beam such that a cross-sectional width of the light beam reaching said one or more remote platforms is substantially greater by one or more orders of magnitude from lateral dimensions of a light detector mounted on said one or more remote platforms.

29. A guidance system for remote guidance of one or more remote platforms towards a target destination, the guidance system comprising:

a light module comprising a light source, an optical output portion directing said light beam towards said one or more remote platforms, and a controller;

a spatial light modulator (SLM) placed in an optical path of a light beam emitted from said light source and configured and operable for forming a spatiotemporal pattern within a cross-section of the light beam by dynamically switching between different programmable spatial patterns, and a guidance detection module adapted to be furnished on said one or more remote platforms, said guidance detection module includes an optical sensor adapted to detect at least one cross-sectional region of said light beam and a control unit connectable to said sensor and adapted to identify at least one of a spatial or temporal pattern in said detected at least one cross-sectional region, decode said pattern to determine the navigation instructions encoded therein, and operate steering modules of said one or more remote platforms to direct said one or more remote platforms in accordance with said navigation instructions towards said target, wherein said controller is configured and operable for obtaining guidance information indicative of guidance instructions for navigating the remote platform, and operating said SLM by switching between the different programmable spatial patterns to spatially and temporally modulate the cross section of the light beam for encoding said guidance information in the spatiotemporal pattern in the form of a plurality of spatially distributed cross-sectional regions within the cross-section of said light beam having respectively distinguishable temporal light patterns formed therein, thereby enabling navigation of said one or more remote platforms to the target by detecting at least a cross-sectional region of said light beam and decoding a portion of said guidance information encoded in said cross-sectional region of said light beam to determine guidance instructions for navigating said one or more remote platforms towards said target destination.

30. The guidance system of claim 29 wherein:

said light pattern is a spatiotemporal pattern spatially distributed in a plurality of cross-sectional regions of said light beam and wherein light in said plurality of cross-sectional regions is temporally modulated with respectively distinguishable temporal modulation patterns; and said control unit is adapted to identify a temporal modulation pattern in the detected cross-sectional region, and determine said guidance instructions based on said temporal modulation pattern.

31. The guidance system of claim 30 wherein:

said sensor includes at least one light sensitive pixel capable of detecting said temporal modulation pattern encoded in said cross-sectional region of the light beam; and lateral dimensions of said light sensitive pixel are substantially smaller than lateral dimensions of said cross-sectional region, providing that said light sensitive pixel senses said temporal light modulation pattern from substantially a single cross-sectional region thereby enabling accurately and unambiguously determining said temporal light modulation pattern.

32. The guidance system of claim 31 wherein duration of said temporal modulation pattern is substantially shorter than a characteristic time interval between modifications of position and/or scale of said spatial part of said spatiotemporal light pattern and wherein said light sensitive pixel is operated with integration time substantially shorter than duration of said temporal modulation pattern.

33. A method for remote guidance of one or more remote platforms towards a target destination, the method comprising:

operating a light source to generate a light beam to illuminate said one or more remote platforms;

providing a spatial light modulator (SLM) placed in an optical path of said light beam, whereby said SLM is operable for forming a spatiotemporal pattern within a cross-section of the light beam by dynamically switching between different programmable spatial patterns;

obtaining guidance information indicative of guidance instructions for navigating said remote platform;

operating said SLM to spatially and temporally modulate the cross section of the light beam by switching between the different programmable spatial patterns to encode said guidance information in the spatiotemporal pattern in the form of a plurality of spatially distributed cross-sectional regions having respectively distinguishable temporal light patterns within the cross-section of said light beam, thereby enabling navigation of said one or more remote platforms to the target by detecting at least a cross-sectional region of said light beam and decoding a portion of said guidance information encoded in said cross-sectional region;

providing optical path data including at least one of stabilization data indicative of deviation of an optical path of said light beam from a nominal optical path along which said light beam should be projected to navigate said one or more remote platforms to said target and target position data indicative of a position of said target, from which said nominal optical path can be determined; and operating said SLM to adjust a lateral position of said spatial light pattern within the cross-section of the light beam based on said optical path data, to thereby compensate for at least one of said deviations of the optical path and changes in said position of the target.

34. The method of claim 33 further comprising:

providing distance data indicative of a distance towards said one or more remote platforms, and data indicative of a degree of collimation of said light beam; and operating said SLM to adjust a scale of said spatial light pattern based on said distance data and said degree of collimation to compensate for divergence of said light-beam when propagating to said one or more remote platforms.

* * * * *